United States Patent [19]

Hayashi et al.

[11] Patent Number: 4,711,462

[45] Date of Patent: Dec. 8, 1987

[54] INJECTION SKI AND A METHOD OF MANUFACTURING SAME

[75] Inventors: Keijiro Hayashi, Takatsuki; Toshimi Awano, Ohogaki, both of Japan

[73] Assignee: Mizuno Corporation, Osaka, Japan

[21] Appl. No.: 880,347

[22] Filed: Jun. 25, 1986

Related U.S. Application Data

[63] Continuation of Ser. No. 476,789, Mar. 18, 1983, abandoned.

[30] Foreign Application Priority Data

Mar. 20, 1982 [JP] Japan ..... 57-45274

[51] Int. Cl.[4] ..... A63C 5/12

[52] U.S. Cl. ..... 280/610; 264/46.7

[58] Field of Search ..... 280/609, 610; 264/46.5, 264/46.6, 46.7; 428/159

[56] References Cited

U.S. PATENT DOCUMENTS

| | | | |
|---|---|---|---|
| 2,362,380 | 11/1944 | Kallstrom et al. | 280/610 |
| 2,560,693 | 7/1951 | Hickman | 280/610 |
| 2,634,136 | 4/1953 | Tribelhorn | 280/610 |
| 4,130,614 | 12/1978 | Saidla | 264/46.7 |
| 4,250,585 | 2/1981 | Thuriault et al. | 264/46.7 |
| 4,259,274 | 3/1981 | Tiitola | 280/610 |
| 4,382,610 | 5/1983 | Arnsteiner | 280/610 |

FOREIGN PATENT DOCUMENTS

| | | | |
|---|---|---|---|
| 1090667 | 4/1955 | France | 280/610 |
| 1290974 | 3/1962 | France | 280/610 |

*Primary Examiner*—John J. Love
*Assistant Examiner*—Ross Weaver
*Attorney, Agent, or Firm*—Fleit, Jacobson, Cohn & Price

[57] ABSTRACT

An injection ski comprises a pair of spaced composite elements and an expanded plastic interposed between the composite elements. The upper composite element is provided with convex portions formed thereon to prevent the composite element from sagging due to its own weight during moulding operation of the ski.

5 Claims, 9 Drawing Figures

INJECTION SKI AND A METHOD OF MANUFACTURING SAME

This application is a continuation, of application Ser. No. 476,789, filed Mar. 18, 1983 now abandoned.

This invention relates to an injection ski and a method for manufacturing the same.

A conventional injection ski 1 is illustrated in FIG. 1 of the accompanying drawings and manufactured by positioning a lower composite element 6 in a lower mould 2, the element 6 including a running surface member 3, edges of steel 4 and a reinforcing member 5, placing an upper flat composite element 10 on steps 7 formed in the inner walls of the lower mould 2, the upper composite element 10 including an upper surface member 8 and a reinforcing member 9 formed integrally with each other, placing an upper mould 11 on the upper composite element 10, injecting an expandable plastic into a space 12 defined between the upper and lower composite elements 10 and 6 and conducting expanding and curing of the plastic, as shown in FIG. 2.

Such a method has a disadvantage in that the upper composite element 10 which is supported on the mould steps 7, sags due to its own weight and this results in formation of a gap between the upper composite element and the upper mould. The injected expandable plastic flows into the gap to dirty the upper surface of the ski. This results in a less quality of the finished ski, which would not be commercially accepted. In order to eliminate this disadvantage resulting from the sagging of the upper composite element, an attempt has been made to more stiffen the upper composite element by either employing the reinforcing member 9 having a greater thickness or the upper surface member 8 having a higher rigidity. However, this measure has a disadvantage in that the finished ski may provide extremely high flexual and torsional rigidities which would make it impossible for average skiers to manipulate their ski.

A main object of the present invention is to provide an injection ski having a good manipulative character which is suitable for advanced skiers as well as beginners.

Another object of the invention is to provide an injection ski having an upper composite element so shaped as to avoid any its sagging during moulding operation thereof.

Further object of the invention is to provide a method for manufacturing a ski of a type comprising a pair of upper and lower spaced composite elements and an expanded plastic interposed between the upper and lower composite elements wherein the upper composite element is supported in a mould without any sagging during an injection moulding.

Other objects and advantages of the invention will become more apparent from the following description on preferred embodiments of the invention with reference to the accompanying drawings in which.

Figure 1:
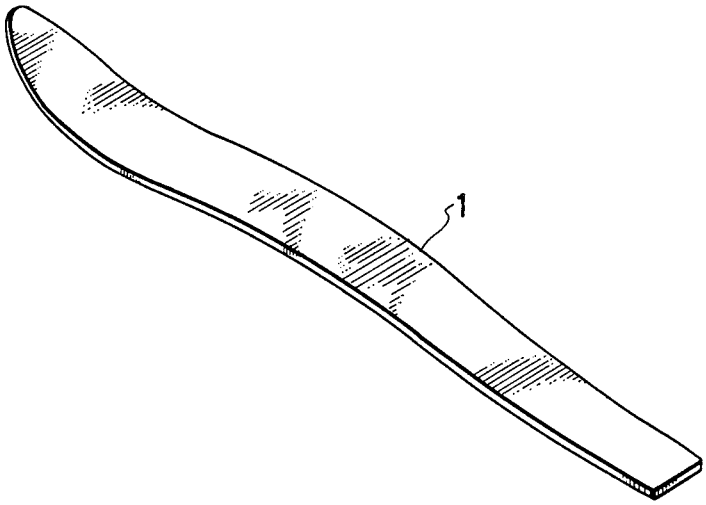
FIG. 1 PRIOR ART
FIG. 1 is a perspective view of a conventional injection ski.
Figure 2:
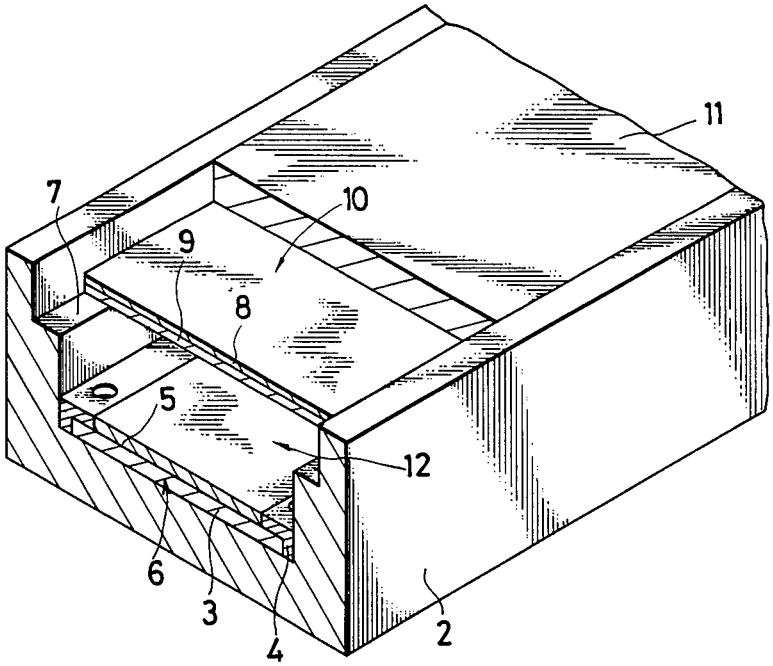
FIG. 2 PRIOR ART
FIG. 2 is a fragmental perspective view of moulds in the process of manufacturing the injection ski illustrated in FIG. 1.
Figure 3:
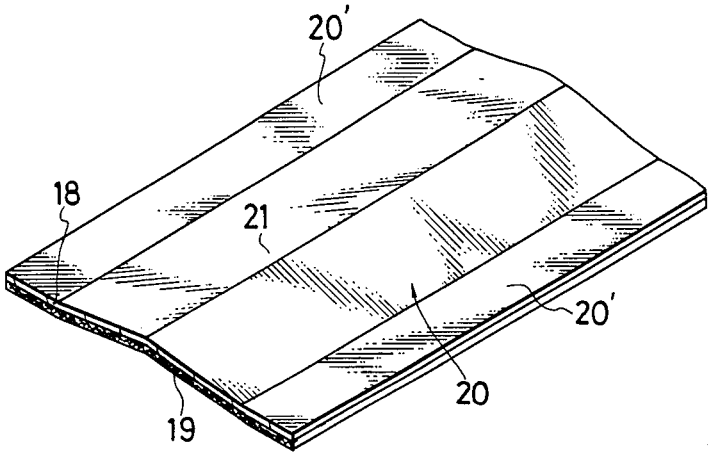
FIG. 3 is a fragmental perspective view of an upper composite element of an injection ski according to the present invention.
Figure 4:
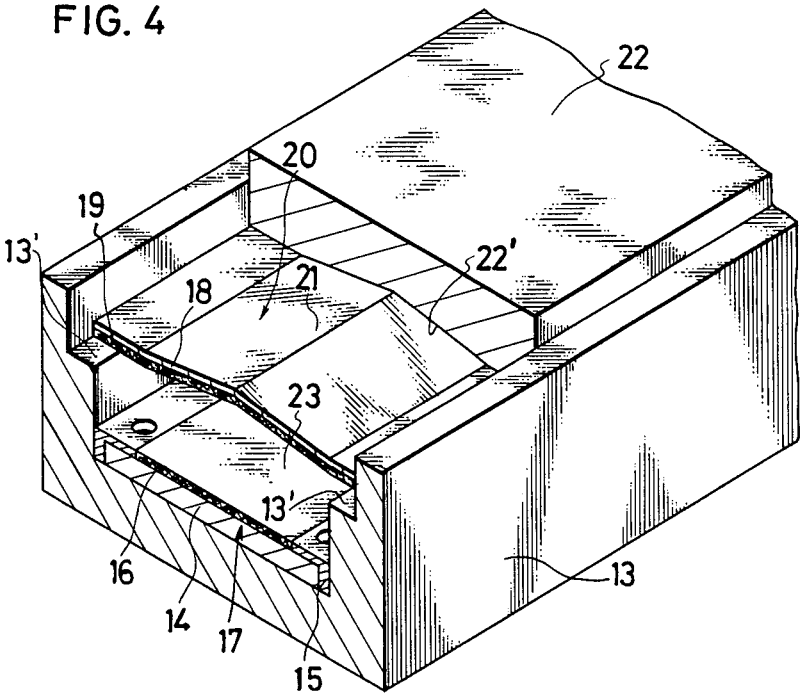
FIG. 4 is a fragmental perspective view showing the process of manufacturing the injection ski according to the invention, using moulds similar to those illustrated in FIG. 2.

Referring to FIG. 3 of the drawings, there is shown an upper composite element 20 comprising an upper surface member 18 and a reinforcing member 19. The upper composite element 20 includes flat ear portions 20' and 20' and convex portions 21 bent upwardly to a shape of roof between the ear portions 20' and 20' and spaced apart along the length thereof (only one of the convex portions being illustrated). As can be seen in FIG. 4, a lower mould 13 has a lower composite element 17 located on the bottom thereof and comprising a running surface member 14, edges of steel 15 and a reinforcing member 16. Then, the upper composite element 20 is placed at its flat ear portions on steps 13' and 13' formed in the inner wall of the mould 13 to define a space 23 between the lower and upper composite elements 17 and 20. An upper mould 22 has at its lower surface 22' a configuration mating with the convex portions 21 of the upper composite element 20 and is placed on it. An expandable plastic is then injected into the space 23 and subjected to an expanding and curing operation. During production of the ski, the upper composite element 20 is supported on the steps 13' and 13' without any sagging because of the existance of the convex portions 21 thereof so that no gap is formed between the upper composite element 20 and the mating upper mould 22.

Figure 5:
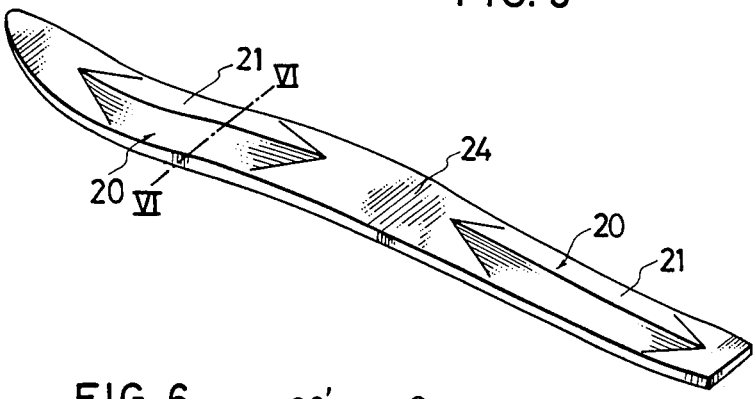
FIG. 5 is a perspective view of the ski according to the invention.
Figure 6:
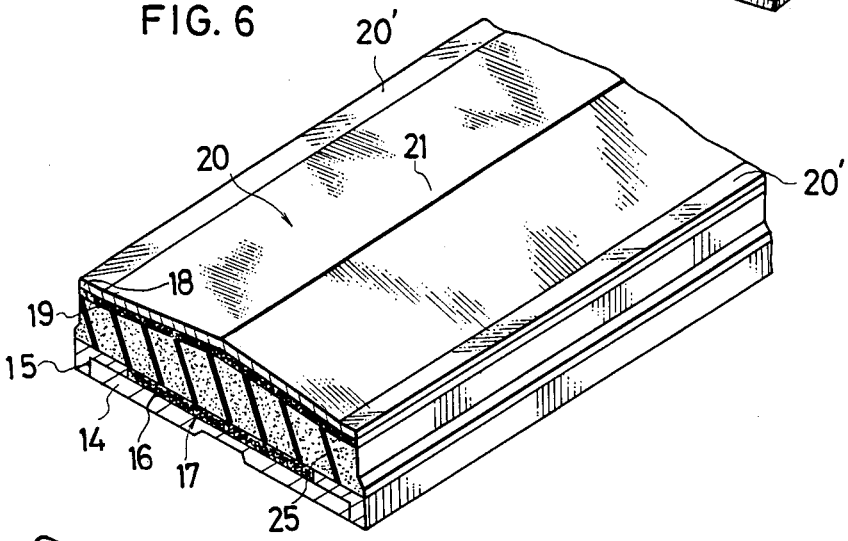
FIG. 6 is a sectional perspective view of the ski taken along line VI—VI of FIG. 5.

The ski thus produced is illustrated in FIG. 5 and comprises the expanded plastic 25 interposed between the upper and lower composite elements 20 and 17 as shown in section in FIG. 6.

Since the convex portions 21 formed on the upper composite element 20 function to prevent it from sagging due to its on weight, each of the upper surface member 18 and the reinforcing member 19 in the upper composite element 20 may be of a rigidity less than in the flat upper composite element. Thus, skis can be easily designed to have flexual and torsional rigidities which are suitable for average skiers.

Preferably, the reinforcing members 16 and 19 are of metal, glass fiber reinforced plastic or carbon fiber reinforced plastic while the upper surface member 18 is of any suitable plastics. The convex portions may be preformed on the reinforcing member 19 by a pressing operation and then, the convex shaped reinforcing member 19 may be bonded to the upper surface member 18 to form an integral composite element. Alternatively, the reinforcing member 19 which may be a perforated FRP sheet or CFRP sheet is preformed to the convex shape in the same manner as that set forth above. The upper surface member 18 is also formed to conform to the convex shape of the reinforcing member 19 so that the upper surface member 18 and the reinforcing member 19 are positioned in the lower mould 13 in a nested relation. During injection of the expandable plastic into the space 23 between the upper and lower composite elements 20 and 17, the expandable plastic flows through the perforations onto the lower surface of the upper surface member 18 to bond the members 18 and 19 to each other.

Figure 7:
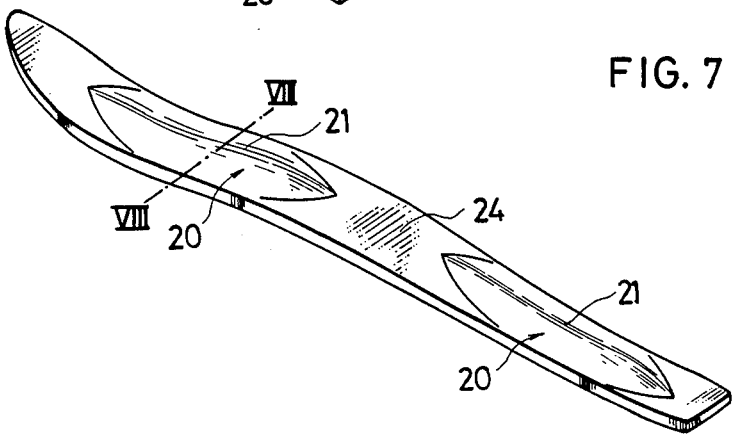
FIG. 7 is a view similar to FIG. 5 but showing another embodiment of the invention.

It will be noted in FIGS. 5 and 7 that a pair of spaced convex portions 21 and 21 extend forwardly and rearwardly of the upper composite element 20 of the ski, leaving a plane area 24 therebetween where a ski safety binding is to be secured. It will be understood according to the invention to provide skis having different flexual and torsional rigidities by changing the lengths of the forward and rearward convex portions on the upper composite element.

Figure 8:
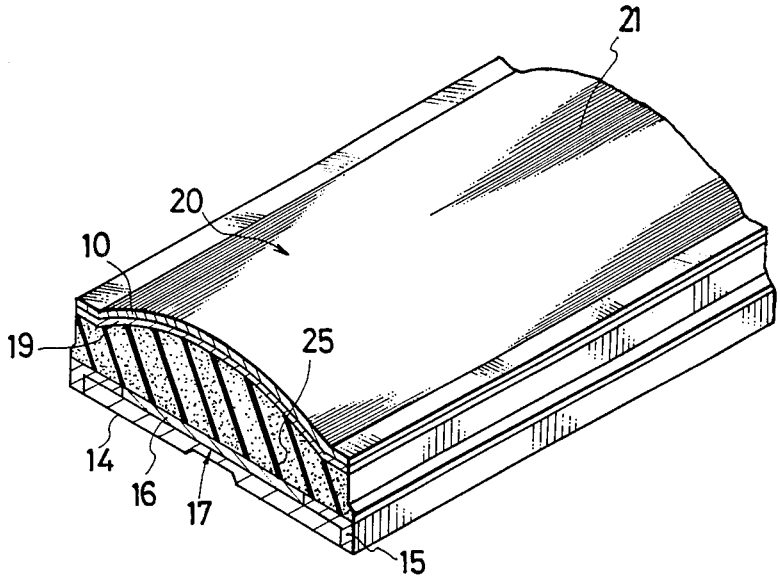
FIG. 8 is a sectional perspective view of the ski taken along line VIII—VIII of FIG. 7.
Figure 9:
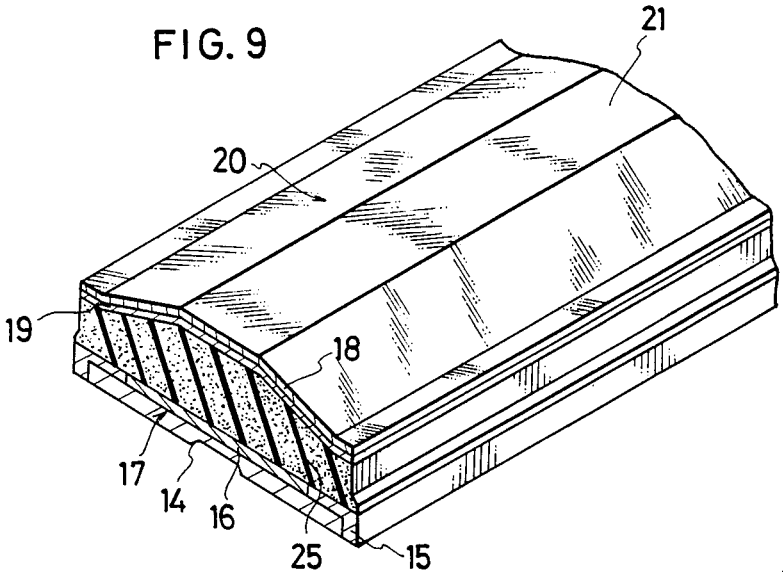
FIG. 9 is a sectional perspective view of a third embodiment of the ski according to the invention.

FIGS. 7 and 8 show another embodiment of the injection ski produced in accordance with the invention in which the upper composite element 20 is provided with convex portions 21 in an arcuated form. FIG. 9 shows a third embodiment of the injection ski according to the invention in which the upper composite element 20 is of a trapezoidal shape including a central flat portion and side portions inclined upwardly from the flat ear portions toward the central flat portion.

Although the preferred embodiments of the ski have been discribed, it is to be understood that many modifications can be made to those skilled in the art without departing from the scope and sprit of the invention.

We claim:

1. An injection ski comprising a pair of spaced upper and lower composite elements having spaced opposite edges and having an expanded plastic interposed between said upper and lower composite elements, including said spaced edges, said upper composite element including an upper surface member and a reinforcing member bonded to one another in mating relationship, with the upper surface member and the reinforcing member both being formed with mating longitudinally spaced forward and rear convex portions, and both being of essentially planar mating construction between the longitudinally spaced forward and rear convex portions to define an essentially planar intermediate surface area where a ski binding is secured.

2. An injection ski as claimed in claim 1 wherein the convex portions have a shape of roof in section.

3. An injection ski as claimed in claim 1 wherein the convex portions have an arcuated section.

4. An injection ski as claimed in claim 1 wherein the convex portions have a trapezoidal section.

5. A method of manufacturing an injection ski comprising the steps of positioning an elongated lower element in a lower mould member, providing an elongated upper composite element which includes an upper surface member and a reinforcing member having opposed mating surfaces, said upper surface member and reinforcing member of the upper composite element both including pairs of longitudinally spaced mating convex portions on respective opposite sides of an intermediate essentially planar ski binding area such that the upper composite element will not sag of its own weight when placed in the lower mould member, placing opposite edges of the upper composite element on steps in the lower mould member to define a space between the lower element and the upper composite element, positioning an upper mould member over the upper composite element, said upper mould member having a lower inner surface having a configuration which mates with the longitudinally spaced convex portions of the upper composite element, injecting an expandable plastic into the space between the lower element and the upper composite element, and expanding and curing the plastic.

* * * * *